US011781280B2

(12) United States Patent
Lyu et al.

(10) Patent No.: US 11,781,280 B2
(45) Date of Patent: Oct. 10, 2023

(54) LOCAL DEEP EXCAVATION AND BACKFILLING STRUCTURAL SUBGRADE AND ITS RAPID CONSTRUCTION METHOD

(71) Applicant: Tongji University, Shanghai (CN)

(72) Inventors: Xilin Lyu, Shanghai (CN); Zhiwei Xie, Shanghai (CN); Bowen Cheng, Shanghai (CN)

(73) Assignee: Tongji University, Shanghai (CN)

( * ) Notice: Subject to any disclaimer, the term of this patent is extended or adjusted under 35 U.S.C. 154(b) by 0 days.

(21) Appl. No.: 17/715,367

(22) Filed: Apr. 7, 2022

(65) Prior Publication Data

US 2023/0203775 A1 Jun. 29, 2023

(30) Foreign Application Priority Data

Dec. 28, 2021 (CN) ..... 202111627933.X

(51) Int. Cl.

| | |
|---|---|
| ***E02D 17/08*** | (2006.01) |
| ***E02D 17/12*** | (2006.01) |
| ***E02D 29/00*** | (2006.01) |
| *E02D 17/04* | (2006.01) |
| *E02D 27/16* | (2006.01) |
| *E02D 29/05* | (2006.01) |

(52) U.S. Cl.

CPC ..... *E02D 17/12* (2013.01); *E02D 17/08* (2013.01); *E02D 29/10* (2013.01); *E02D 17/04* (2013.01); *E02D 27/16* (2013.01); *E02D 29/05* (2013.01)

(58) Field of Classification Search

CPC ..... E02D 17/04; E02D 17/08; E02D 17/12; E02D 27/16; E02D 27/34; E02D 29/05

See application file for complete search history.

(56) References Cited

FOREIGN PATENT DOCUMENTS

| | | | |
|---|---|---|---|
| CN | 108643199 | A | 10/2018 |
| CN | 208039269 | U | 11/2018 |

(Continued)

OTHER PUBLICATIONS

CNIPA, Notification of a First Office Action for CN202111627933.X, dated Jul. 11, 2022.

(Continued)

*Primary Examiner* — Sunil Singh

(74) *Attorney, Agent, or Firm* — Rachel K. Pilloff; Sean A. Passino; Pilloff Passino & Cosenza LLP

(57) ABSTRACT

A subgrade with local deep excavation and backfilling structure and a rapid construction method thereof are provided. Supporting cast-in-place piles are laid at positions where an underground pipe gallery is located in a subgrade structure, and soil there between are longitudinally excavated to form a line-shaped foundation pit. A bottom of the line-shaped deep foundation pit is reinforced to support the underground pipe gallery, and lateral peripheral regions and top peripheral regions of the underground pipe gallery are backfilled with block geobag reinforced fillers. Geogrids are placed on the top of the underground pipe gallery, then backfilling compaction and reinforcing are performed, and the geogrids are fixedly assembled with anchor bolts. The construction method is simple and easy. By using compacted block geobag reinforced fillers and cement solidified slurry, an overall quality of the subgrade structure after backfilling can be ensured, and construction period and cost can be greatly reduced.

7 Claims, 2 Drawing Sheets

(56) References Cited

FOREIGN PATENT DOCUMENTS

| | | |
|---|---|---|
| CN | 209039896 U | 6/2019 |
| CN | 111519647 A | 8/2020 |

OTHER PUBLICATIONS

Tongji University (Applicant), Reply to Notification of a First Office Action for CN202111627933.X, w/ replacement claims, dated Aug. 15, 2022.

Tongji University (Applicant), Supplemental Reply to Notification of a First Office Action for CN202111627933.X, w/ (allowed) replacement claims, dated Oct. 25, 2022.

CNIPA, Notification to grant patent right for invention in CN202111627933.X, dated Nov. 4, 2022.

LOCAL DEEP EXCAVATION AND BACKFILLING STRUCTURAL SUBGRADE AND ITS RAPID CONSTRUCTION METHOD

TECHNICAL FIELD

The disclosure relates to the technical field of geotechnical engineering, and in particular to subgrade with local deep excavation and backfilling structure and a rapid construction method thereof.

BACKGROUND

Due to the lagging planning and other reasons, comprehensive underground facilities and structures are not built in the as-built areas of some cities, especially in the soft soil areas which have been the pioneers in urbanization. The settlement of roads in these areas is severe after long-term operation in these areas. In the process of building or renovating some underground facilities, it is often necessary to support and excavate the subgrade structure first, then construct the underground structure, and then backfill the soil for subgrade compaction. In order to ensure underground structures are steady, the conventional way is to set piles at the bottom of underground structures and facilities to control the settlement. However, there is no targeted control method for the settlement of the overlying backfilling and the original subgrade, which leads to uncoordinated stiffness and easily leads to differential settlement during the later operation of the road. Especially in the soft soil areas where the existing subgrade itself is still constantly settling, the differential settlement control between the existing subgrade structure and the backfilled subgrade structure is particularly important.

SUMMARY

Embodiments according to the disclosure aim at solving or improving at least one of the above technical problems.

A first aspect of the embodiment according to the disclosure is to provide a rapid construction method of subgrade with local deep excavation and backfilling structure.

A second aspect of the disclosure also provides a subgrade with local deep excavation and backfilling structure.

Embodiments of the first aspect of the disclosure provide a rapid construction method of subgrade with local deep excavation and backfilling structure, including: setting supporting cast-in-place piles at positions where a subgrade structure is provided with an underground pipe gallery, and longitudinally excavating soil between the supporting cast-in-place piles to form a line-shaped foundation pit; Reinforcing the bottom of the line-shaped deep foundation pit to support the underground pipe gallery, and backfilling lateral peripheral regions and top peripheral regions of the underground pipe gallery with block geobag reinforced fillers; and, placing geogrids on the top of the underground pipe gallery, then backfilling, compacting and reinforcing, and fixedly assembling anchor rods on the geogrids. The anchor rods are inserted into the geogrids, the supporting cast-in-place piles and the subgrade structure, and gaps between the block geobag reinforced fillers are filled with cement solidified slurry.

In addition, the technical scheme provided according to the embodiments of the disclosure may also have the following additional technical features:

In any of the above technical schemes, the step of reinforcing the bottom of the line-shaped foundation pit to support the underground pipe gallery may include: setting a cement-soil mixing pile below the bottom of the underground pipe gallery, the cement-soil mixing pile passing through a soft soil layer and being inserted into a hard soil layer or a designed depth; between the bottom of the underground pipe gallery and the top of the cement-soil mixing piles, a macadam stabilized base layer and a cement cushion layer are laid in sequence from bottom to up.

In any of the above technical schemes, the step of backfilling the lateral peripheral regions and the top peripheral regions of the underground pipe gallery with block geobag reinforced fillers may include: laying the block geobag reinforced fillers around the underground pipe gallery and in the top peripheral regions; cement solidified slurry being used for filling between the block geobag reinforced fillers, and making the cement solidified slurry be higher than the top of the block geobag reinforced fillers and then fully fill the gaps.

In any of the above technical schemes, the step of placing geogrids on the top of the underground pipe gallery, then backfilling, compacting and reinforcing, and fixedly assembling anchor rods on the geogrids may include: backfilling coarse aggregate cement mixed backfilled soil in the middle location on the top of the underground pipe gallery, making the geogrids wrap the coarse aggregate cement mixed backfilled soil and form a loop with the block geobag reinforced fillers, straightening and fixing the anchor rods with bolts and strip gaskets, and under the action of mechanical compaction, connecting the soil of the line-shaped foundation pit and the block geobag reinforced fillers. The anchor rods and the geogrids are secured onto the supporting cast-in-place piles through the bolt and the strip gasket, the soil of the supporting cast-in-place pile and the line-shaped foundation pit is bored/drilled and grouted, and then the anchor rods are inserted and fixed.

In any of the above technical schemes, the rapid construction method of subgrade with local deep excavation and backfilling structure may further include: laying geotechnical mold bags between the block geobag reinforced fillers backfilled in the lateral peripheral regions and the block geobag reinforced fillers backfilled in the top peripheral regions of the underground pipe gallery, and wrapping by the geogrids.

In any of the above technical schemes, the rapid construction method of subgrade with local deep excavation and backfilling structure may further include: laying a geotextile on the inner wall of each the geogrid during placing the geogrids on the top of the underground pipe gallery.

The second aspect of the disclosure provides a subgrade with local deep excavation and backfilling structure, including: a line-shaped foundation pit which is arranged in a subgrade structure and passes through an underground pipe gallery; supporting cast-in-place piles which are arranged on inner walls of the line-shaped foundation pit; and, anchor rods which are fixed into the soil of the line-shaped foundation pit and the supporting cast-in-place piles by drilling and grouting, and further connected with the geogrids. A cement cushion layer, a macadam stabilized base layer and a cement-soil mixing pile are sequentially arranged from top to bottom below the bottom of the underground pipe galley. A coarse aggregate cement mixed backfilled soil, block geobag reinforced fillers and the geogrids are sequentially arranged from inside to outside on the top of the underground pipe gallery. The underground pipe gallery are laid with block geobag reinforced fillers there around. The subgrade with local deep excavation and backfilling structure is excavated and assembled by using the rapid construction method of local deep excavation and backfilling structural subgrade in any one of the above technical schemes.

According to the technical scheme of the disclosure, a rapid construction method of subgrade with local deep excavation and backfilling structure is provided, in which the contained structure may be realized by the steps of any of the above technical scheme methods. Therefore, the subgrade with local deep excavation and backfilling structure provided by the second aspect of the disclosure has all the technical effects of the rapid construction method of the subgrade with local deep excavation and backfilling structure, which will not be repeated herein.

In any of the above technical schemes, geotechnical mold bags may be laid between the top of the underground pipe gallery and the coarse aggregate cement mixed backfilled soil.

In any of the above technical schemes, the anchor rods may be fixedly assembled with the geogrids by bolts and strip gaskets.

In any of the above technical schemes, a geotextile may be installed between the block geobag reinforced fillers and the geogrids.

Additional aspects and advantages of embodiments according to the disclosure will become apparent in the following description, or may be learned by practice according to embodiments of the disclosure.

Figure 1:
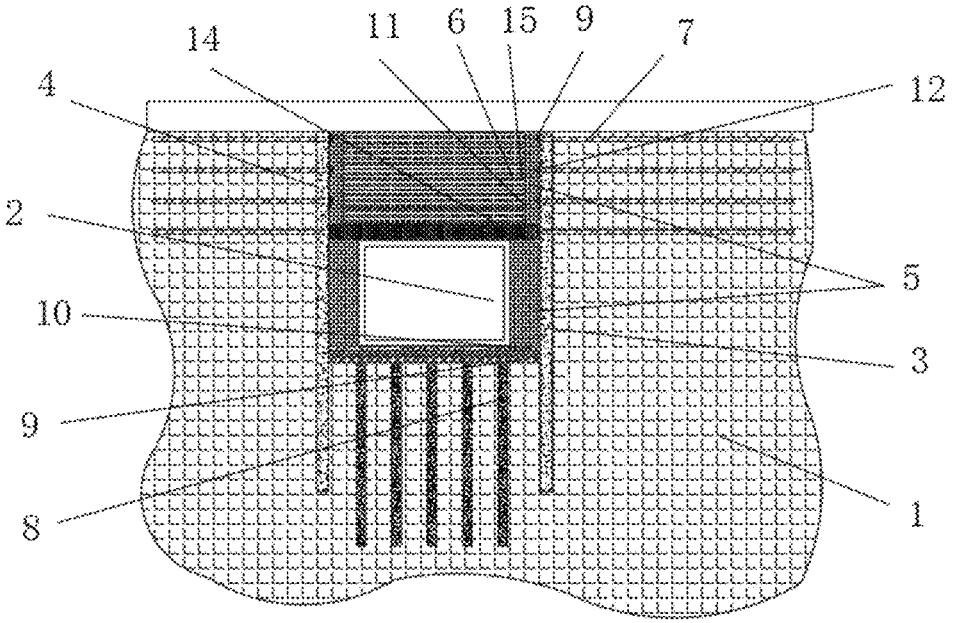
FIG. 1 shows a sectional view of showing a construction process of the disclosure.
Figure 2:
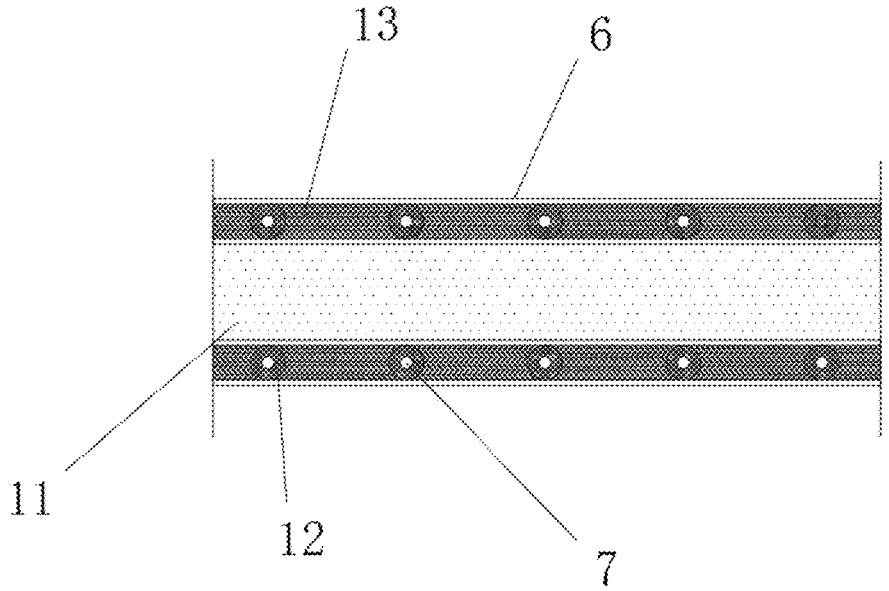
FIG. 2 illustrates a schematic diagram of strip gaskets and their connection structures of the disclosure.
Figure 3:
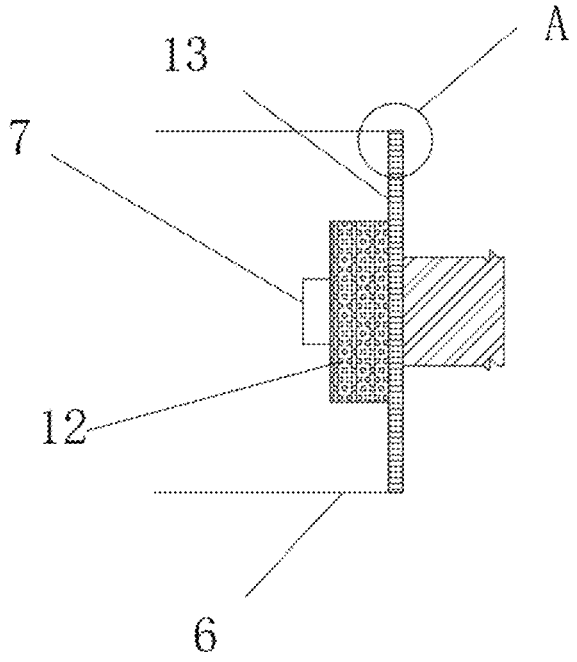
FIG. 3 shows a schematic diagram of an anchor rod and its connection structure of the disclosure.
Figure 4:
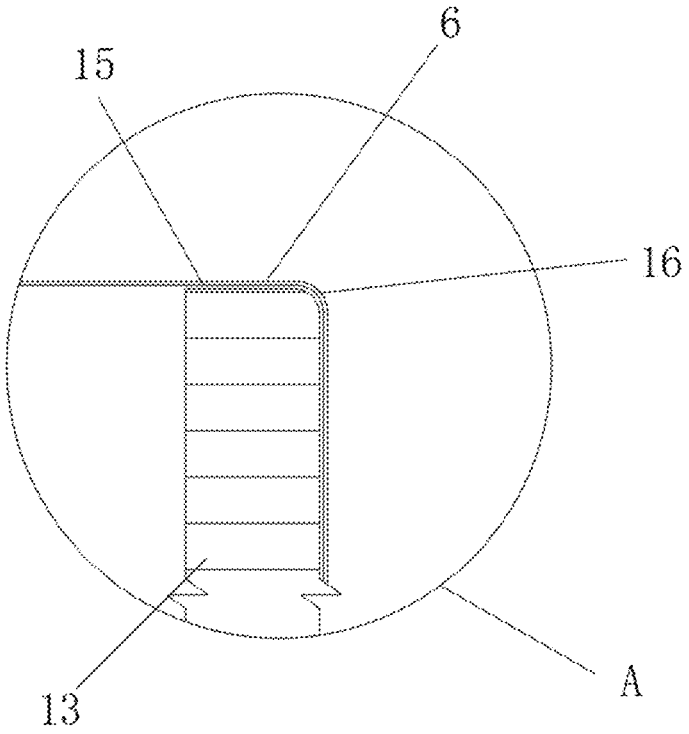
FIG. 4 is an enlarged view of the portion A in FIG. 3.

The corresponding relationship between reference numbers and component names in FIGS. 1-4 are as follows:

subgrade structure 1, underground pipe gallery 2, supporting cast-in-place pile 3, line-shaped foundation pit 4, block geobag reinforced filler 5, geogrid 6, anchor rod 7, cement-soil mixing pile 8, macadam stabilized base 9, cement cushion layer 10, coarse aggregate cement mixed backfilled soil 11, bolt 12, strip gasket 13, geobag 14, geotextile 15 and filleted corner 16.

DETAILED DESCRIPTION OF EMBODIMENTS

In order to better understand the above-mentioned objects, features and advantages of the disclosure, the disclosure will be described in further detail below with reference to the drawings and detailed description. It should be noted that the embodiments of this application and the features in the embodiments may be combined with each other without conflict.

In the following description, many specific details are set forth in order to fully understand the disclosure. However, the disclosure may be implemented in other ways different from those described here, so the protection scope of the disclosure is not limited by the specific embodiments disclosed below.

Referring to FIGS. 1-4, an embodiment of the first aspect of the disclosure provides a construction method including: laying supporting cast-in-place piles 3 at positions where the underground pipe gallery 2 is arranged in the subgrade structure 1, and excavating longitudinally the soil between the supporting cast-in-place piles 3 to form a line-shaped foundation pit 4; reinforcing the bottom of the line-shaped deep foundation pit to support the underground pipe gallery 2, and backfilling lateral peripheral regions and top peripheral regions of the underground pipe gallery 2 with block geobag reinforced fillers 5; placing geogrids 6 on the top of the underground pipe gallery 2, then backfilling, compacting and reinforcing, and fixedly assembling anchor rods 7 on the geogrids 6. The anchor rods 7 are inserted into the geogrids 6, the supporting cast-in-place piles 3 and the subgrade structure 1, and gaps between the block geobag reinforced fillers 5 are filled with cement solidified slurry.

The rapid construction method of subgrade with local deep excavation and backfilling structure according to an embodiment of the disclosure, in which when the supporting cast-in-place piles 3 and the subgrade structure 1 are inserted and fixed with the anchor rods 7, the supporting cast-in-place piles 3 and the subgrade structure 1 are fixed and assembled in a way of pre-drilling and grouting. The disclosure makes full use of the vertical channel excavated by the line-shaped foundation pit 4 to reinforce the original subgrade structure 1 by drilling and grouting, improves the strength and anti-deformation ability of the subgrade structure 1 by means of split grouting, and at the same time, the settlement deformation of the subgrade structure 1 under the action of overlying load by using the synergistic effect of the grouting anchor rod 7 and the supporting filling pile may be well controlled.

According to the embodiment of the disclosure, the pre-compacted block geobag reinforced fillers 5 is used to backfill the areas/regions around and above the underground pipe gallery 2 which are not convenient for mechanical construction or poor treatment, and cement solidified slurry is used for filling, which may solve the long-term limitation that the backfilled soil around the underground pipe gallery 2 cannot be compacted, and at the same time ensure the lateral stability of the underground pipe gallery 2.

According to an embodiment of the disclosure, the collaborative connection of the geogrids 6, the anchor rods 7, the supporting cast-in-place piles 3 and the block geobag reinforced fillers 5 using cement solidified slurry is utilized to ensure the deformation stability of the backfilled subgrade structure 1, so that the subgrade structure 1 and the backfilled integral structure form a whole, and the uneven settlement may be prevented.

The construction technology of an embodiment of the disclosure is simple and feasible, and the compacted block geobag reinforced filler 5 has the advantages of convenient operation and high strength, so that the subgrade structure 1 may be quickly backfilled, and the grouting caulking method of cement solidified slurry is used to effectively ensure the overall quality of the subgrade structure 1 after backfilling, and the construction period and the total cost may be greatly reduced.

Further, the inner and outer edges of the geogrid 6 are provided with filleted corners 16, and the corners of the geogrid 6 are arc-shaped, which greatly reduces the stress concentration and avoids the geogrid 6 from being torn and damaged due to excessive external force.

Further, drilling holes are drilled at both sides of the construction positions of the line-shaped foundation pit 4, and reinforcing cages are arranged to form the supporting cast-in-place piles 3. On one hand, the permanent reinforced concrete cast-in-place piles may be used as the fixed structure of the later drilling anchor rods 7 and geogrids 6; on the other hand, the lateral deformation of the line-shaped foundation pit 4 may be ensured, thus ensuring the good stability of the subgrade structure 1 and the backfilled subgrade.

Further, the concrete cast-in-place piles 3 (supporting cast-in-place piles 3) support and reinforce the line-shaped foundation pit 4, and the steel bar used as horizontal support is installed on the concrete cast-in-place pile 3 while digging, so as to ensure that the inner part of the line-shaped foundation pit 4 will not be deformed and collapsed.

In any of the above embodiments, the steps of reinforcing the bottom of the line-shaped foundation pit 4 to support the underground pipe gallery 2 may include setting the cement-soil mixing piles 8 below the bottom of the underground pipe gallery 2, and inserting the cement-soil mixing piles 8 through a soft soil layer into a hard soil layer or a designed depth; between the bottom of underground pipe gallery 2 and the top of cement-soil mixing pile 8, a macadam stabilized base layer 9 and cement cushion layer 10 are laid in sequence from bottom to top.

In some embodiments, after the line-shaped foundation pit 4 is excavated to a designed depth, the bottom of the line-shaped foundation pit 4 is treated and the cement-soil mixing piles 8 are set at intervals to ensure the vertical deformation stability of the subgrade structure in the long-term operation process. Then the macadam stabilized base layer 9 and the cement cushion layer 10 are laid in the line-shaped foundation pit 4, and the cement-soil mixing piles 8 arranged in matrix are set below the bottom and inserted into the hard soil layer through the soft soil layer. A support structure arranged in matrix may be formed at the bottom, and the firm support provided by hard soil layer may be provided at the bottom, so that the whole structure will not collapse, and the good stability of the whole structure is ensured. By laying the macadam stabilized base layer 9 and the cement cushion layer 10, the point supports of cement-soil mixing piles 8 arranged in matrix can become a stable surface support, which may avoid the concentrated stress of point force at the bottom and ensures that the local structure will not be broken when the local structure is subjected to the support force.

In any of the above embodiments, the step of backfilling the lateral peripheral regions and the top peripheral regions of the underground pipe gallery 2 with the block geobag reinforced fillers 5 may include: laying the block geobag reinforced fillers 5 around the underground pipe gallery 2 and in the top peripheral of the underground pipe gallery 2 respectively; the cement solidified slurry being used to fill the spaces/gaps between the block geobag reinforced fillers 5, and the cement solidified slurry being arranged higher than the top of the block geobag reinforced fillers 5 and fully filling the gaps.

In some embodiments, the underground pipe gallery 2 is built and installed according to the needs. After the installation of the underground pipe gallery 2 is completed, the block geobag reinforced fillers 5 compacted in advance are laid in the narrow space on both sides of the underground pipe gallery 2 which is not convenient for mechanical construction by using the quick construction technology of cement solidified slurry. After the compacted block geobag reinforced fillers 5 are placed according to the space needs, the mixed grout of cement, curing agent and fine-grained soil are used to pour the gaps between the block geobag reinforced fillers 5, and finally the grout surface is kept higher than the top surface of the block geobag reinforced fillers 5. The cement, curing agent and fine-grained soil mixed slurry in the disclosure have fast consolidation, which may greatly shorten the construction time. At the same time, the block geobag reinforced filler 5 in the disclosure is compacted into a block in advance by a special compaction machine, so that the good wrapping force of the block geobag reinforced filler 5 may be utilized, and at the same time, the compactness of the filler may be ensured to meet the design requirements.

Compared with the ordinary backfilled soil, the block geobag reinforced fillers 5 are not only compact in structure and convenient to transport, but also can be stacked and placed one by one by constructors, and then poured with cement solidified slurry, so that the block geobag reinforced fillers 5 stacked and placed can be connected and fixed with each other to form a tight and firm entity, and no external mechanical equipment is needed to suppress the block geobag reinforced fillers 5 in the placing.

Keeping the height of the block geobag reinforced fillers 5 backfilled and compacted on both sides of the underground pipe gallery 2 flush with the top of the underground pipe gallery 2, and lay a layer of geogrids 6 on the top of the underground pipe gallery 2. Because of the mechanical difficulty in construction on both sides of the supporting cast-in-place piles 3, filling the block geobag reinforced fillers 5 compacted by the above compaction method, and pouring the gaps among the block geobag reinforced fillers 5 with cement solidified slurry to ensure that the backfilled subgrade on the upper part of the underground structure has high overall compactness and strength.

In any of the above embodiments, the geogrids 6 are placed on the top of the underground pipe gallery 2 for backfilling, compaction and reinforcement, and the steps of fixing and assembling the anchor rods 7 on the geogrids 6 include backfilling the coarse aggregate cement mixed backfilled soil 11 in the middle location on the top of the underground pipe gallery 2, making the geogrids 6 wrap the coarse aggregate cement mixed backfilled soil 11 and form a loop with the block geobag reinforced fillers 5, and straightening and fixing the anchor rods 7 through bolts 12 and strip gaskets 13. Under the action of mechanical compaction, the soil of the line-shaped foundation pit 4 is connected with the whole structure of the block geobag reinforced fillers 5. The anchor rods 7 and geogrids 6 are fixed onto the supporting cast-in-place piles 3 by bolts 12 and strip gaskets 13, and the supporting cast-in-place pile 3 and soil of the line-shaped foundation pit 4 are bored and grouted, and then the anchor rods 7 are inserted therein.

In some embodiments, the backfilled section of the upper part of the underground pipe gallery 2 is paved with geogrids 6 at intervals to further ensure the settlement control of the backfill subgrade. Split grouting combined grouting bolts 7 are used to reinforce the soil around the local deep excavation area to control the settlement of the existing subgrade. Grouting holes are drilled into the subgrade structure 1 on the supporting cast-in-place piles 3, and the subgrade soil structure is reinforced by split grouting. Then installing anchor rods 7 in the holes and being grouted for sealing. The combined treatment of the subgrade structure 1 with split grouting and grouted anchor rods 7 may ensure that the settlement and deformation of the existing soft subgrade may be controlled in later operation, so that the subgrade structure 1 may be effectively connected with the supporting cast-in-place piles 3 through grouting bodies, anchor rods 7, and the settlement of soft soil may be effectively prevented and controlled.

Geogrids 6, grouted anchors 7 and supporting cast-in-place piles 3 are organically combined and connected, forming an integral settlement control coordination mechanism, which may effectively control the settlement problem of existing subgrade and backfilled subgrade. Geogrids 6 are fixed with bolts 12 and strip gaskets 13 of anchor rods 7, and the starting point and ending point of geogrid 6 are fixed by the strip gaskets 13, forming an effective loop, and the backfilled soil in the geogrid 6 is well reinforced, effectively ensuring the settlement problem of the backfilled subgrade. Geogrids 6, anchor rods 7 and supporting cast-in-place piles 3 are connected together with bolts 12 and strip gaskets 13, forming an organically combined structure, which may effectively reduce the uneven settlement problem of existing subgrade and backfilled subgrade, and at the same time, the settlement problem of existing soft subgrade may also be effectively solved by using the force transmission of anchor rods 7 and splitting grouting.

In any of the above embodiments, a rapid construction method of subgrade with local deep excavation and backfilling structure may further include: laying geotechnical mold bags 14 between the block geobag reinforced fillers 5 around the underground pipe gallery 2 and the block geobag reinforced fillers 5 in the top peripheral regions of the underground pipe gallery 2, and wrapping by geogrids 6.

In some embodiments, as large-scale mechanical compaction damages the roof of underground structure, the geotechnical mold bags 14 with a height of about 0.5 meters are laid first, and the mixed slurry of cement, curing agent and fine-grained soil is poured to ensure that the liquid level is higher than that of the geotechnical mold bags 14. The coarse-grained material and cement mixture with good properties are filled above the geotechnical mold bags 14, and the geotechnical mold bags 14 are watered for curing and mechanically compacted during the filling process.

In any of the above embodiments, a rapid construction method of subgrade with local deep excavation and backfilling structure may further include: laying a geotextile 15 on an inner wall of each the geogrid 6 when placing the geogrids 6 on the top of underground pipe gallery 2.

In some embodiments, the geotextile 15 has high strength. With the use of plastic fibers, the geotextile 15 may maintain sufficient strength and elongation in dry and wet conditions, resist corrosion for a long time in soil and water with different pH values, have good water permeability. As there are gaps between fibers, so the geotextile 15 has good water permeability and good anti-microbial property, and will not be damaged by microorganisms and insects.

The concentrated stress may be effectively diffused, transmitted or decomposed when the water flows through the structure, preventing the structure from being damaged by external forces, and protecting the soil. When the water comes into contact with the inner structure of the device, due to good air permeability and water permeability, the geotextile 15 may be used to make the water flow pass through, thus effectively intercepting soil particles, fine sand, small stones, etc., so as to maintain the good stability of water and soil engineering.

The second aspect of the disclosure provides a subgrade with local deepwise excavation and backfilling structure, including: the line-shaped foundation pit 4 set on the subgrade structure 1 and passing through the underground pipe gallery 2; the supporting cast-in-place piles 3 arranged on inner walls of the line-shaped foundation pit 4; and the anchor bolts 7 fixed onto the soil of the line-shaped foundation pit 4 and the supporting cast-in-place piles 3 by drilling and grouting. The anchor bolts 7 are connected with the geogrids 6. The cement cushion layer 10, the macadam stabilized base layer 9 and the cement-soil mixing piles 8 are sequentially arranged from top to bottom below the bottom of the underground pipe gallery 2. The coarse the aggregate cement mixed backfilled soil 11, the block geobag reinforced fillers 5 and the geogrids 6 are sequentially arranged from inside to outside on the top of the underground pipe gallery 2. The block geobag reinforced fillers 5 are laid around the underground pipe gallery 2. The local deep excavation and backfilling structural subgrade may be excavated and assembled by using the rapid construction method of subgrade with local deep excavation and backfilling structure in any of the above embodiments.

According to the rapid construction method of subgrade with local deep excavation and backfilling structure provided by the embodiment of the disclosure, since the structure contained therein can be realized by the steps of any of the above-mentioned embodiments, the local deep excavation and backfilling structural subgrade provided by the second aspect of the disclosure has all the technical effects of the rapid construction method of subgrade with local deep excavation and backfilling structure, which will not be repeated here.

In any of the above embodiments, the geotechnical mold bags 14 are laid between the top of the underground pipe gallery 2 and the coarse aggregate cement mixed backfilling 11.

In some embodiments, the geotechnical mold bags 14 are added, and the mixed slurry of cement, curing agent and fine-grained soil is poured to ensure that its liquid level is higher than that of the geotechnical mold bags 14. Coarse-grained materials and cement mixture with good properties are filled above the geotechnical mold bags 14. The coarse aggregate and cement mixture with good properties are filled above the geotechnical mold bags 14. During the filling process, the coarse aggregate and cement mixture are watered, solidified and mechanically compacted, which plays a role in the stable support of the bottom layer, ensuring that the coarse aggregate cement mixed backfilled soil 11 above will not collapse and partially leak, and ensuring successful construction.

In any of the above embodiments, the anchor rods 7 may be fixedly assembled with the geogrids 6 by bolts 12 and strip gaskets 13.

In some embodiments, bolts 12 and strip gaskets 13 are used to assemble and fix the anchor rods 7 and geogrids 6, so that the assembly effect can be uniform and stable, and it is convenient for large-scale implementation of equal quantity and equivalent, and the method is simple and mature.

In any of the above embodiments, the geotextile 15 may be installed between the block geobag reinforced fillers 5 and the geogrids 6.

In some embodiments, the block geobag reinforced fillers 5 in the geogrid 6 may be protected by adding the geotextile 15, and the instability and absence of the internal filler structure caused by the loss of the internal filler to the outside may be avoided, thus ensuring the water erosion resistance in long-term use.

What is claimed is:

1. A construction method of subgrade with local deep excavation and backfilling structure, comprising:

laying longitudinally supporting cast-in-place piles on both sides of an underground pipe gallery at positions where the underground pipe gallery is arranged in a subgrade structure, and excavating longitudinally soil between the supporting cast-in-place piles to form a line-shaped foundation pit;

reinforcing a bottom of the line-shaped foundation pit to support the underground pipe gallery, and backfilling lateral peripheral regions and top peripheral regions of the underground pipe gallery with block geobag reinforced fillers; and placing geogrids on a top of the underground pipe gallery, then backfilling, compacting and reinforcing the top of the underground pipe gallery, and fixedly assembling anchor rods on the geogrids;

wherein inserting the anchor rods into the geogrids, the supporting cast-in-place piles and the subgrade structure, and filling gaps among the block geobag reinforced fillers with cement solidified slurry;

wherein the reinforcing a bottom of the line-shaped foundation pit to support the underground pipe gallery comprises:

setting cement-soil mixing piles below a bottom of the underground pipe gallery, wherein the cement-soil mixing piles penetrate through a soft soil layer and then are inserted into a hard soil layer or a designed depth; and laying a macadam stabilized base layer and a cement cushion layer in sequence from bottom to top between the bottom of the underground pipe gallery and tops of the cement-soil mixing piles;

wherein the backfilling lateral peripheral regions and top peripheral regions of the underground pipe gallery with block geobag reinforced fillers, comprises:

laying the block geobag reinforced fillers in the lateral peripheral regions as well as the top peripheral regions of the underground pipe gallery respectively; and filling the cement solidified slurry among the block geobag reinforced fillers, and making the cement solidified slurry be higher than a top of the block geobag reinforced fillers and fill up the gaps;

wherein grouting holes into the subgrade structure on the supporting cast-in-place piles, reinforcing the subgrade structure by split grouting, installing the anchor rods in the holes and grouting the holes for sealing;

wherein the placing geogrids on a top of the underground pipe gallery, then backfilling, compacting and reinforcing the top of the underground pipe gallery, and fixedly assembling anchor rods on the geogrids comprises:

backfilling a middle location on the top of the underground pipe gallery with coarse aggregate cement mixed backfilled soil, making the geogrids wrap the coarse aggregate cement mixed backfilled soil and form a loop with the block geobag reinforced fillers, fixing the anchor rods and the geogrids by strip gaskets and bolts, and connecting soil of the subgrade structure with an overall structure of the block geobag reinforced fillers under an action of mechanical compaction; and securing the anchor rods and the geogrids onto the supporting cast-in-place piles through the bolts and the strip gaskets, drilling the grouting holes in the soil of the subgrade structure, inserting and fixing the anchor rods in the grouting holes, and then grouting the grouting holes.

2. The construction method of subgrade with local deep excavation and backfilling structure according to claim 1, further comprising:

laying geotechnical mold bags between the block geobag reinforced fillers backfilled in the lateral peripheral regions and the block geobag reinforced fillers backfilled in the top peripheral regions of the underground pipe gallery, and wrapping the geotechnical mold bags by the geogrids.

3. The construction method of subgrade with local deep excavation and backfilling structure according to claim 1, further comprising:

during placing the geogrids on the top of the underground pipe gallery, laying a geotextile on an inner wall of each of the geogrids.

4. A subgrade with local deep excavation and backfilling structure, comprising:

a line-shaped foundation pit, disposed in a subgrade structure and passing through an underground pipe gallery;

supporting cast-in-place piles, arranged on inner walls of the line-shaped foundation pit; and anchor rods, fixed into soil of the subgrade structure and the supporting cast-in-place piles by drilling and grouting, and connected with geogrids;

wherein a cement cushion layer, a macadam stabilized base layer and cement-soil mixing piles are sequentially arranged from top to bottom below a bottom of the underground pipe gallery; a coarse aggregate cement mixed backfilled soil, block geobag reinforced fillers and the geogrids are sequentially arranged from inside to outside on a top of the underground pipe gallery; and the underground pipe gallery are laid with block geobag reinforced fillers there around;

wherein the subgrade with local deep excavation and backfilling structure is excavated and assembled by using the construction method, the construction method comprises:

laying longitudinally supporting cast-in-place piles on both sides of an underground pipe gallery at positions where the underground pipe gallery is arranged in a subgrade structure, and excavating longitudinally soil between the supporting cast-in-place piles to form a line-shaped foundation pit;

reinforcing a bottom of the line-shaped foundation pit to support the underground pipe gallery, and backfilling lateral peripheral regions and top peripheral regions of the underground pipe gallery with block geobag reinforced fillers; and placing geogrids on a top of the underground pipe gallery, then backfilling, compacting and reinforcing the top of the underground pipe gallery, and fixedly assembling anchor rods on the geogrids;

wherein inserting the anchor rods into the geogrids, the supporting cast-in-place piles and the subgrade structure, and filling gaps among the block geobag reinforced fillers with cement solidified slurry;

wherein the reinforcing a bottom of the line-shaped foundation pit to support the underground pipe gallery comprises:

setting cement-soil mixing piles below a bottom of the underground pipe gallery, wherein the cement-soil mixing piles penetrate through a soft soil layer and then are inserted into a hard soil layer or a designed depth; and laying a macadam stabilized base layer and a cement cushion layer in sequence from bottom to top between the bottom of the underground pipe gallery and tops of the cement-soil mixing piles;

wherein the backfilling lateral peripheral regions and top peripheral regions of the underground pipe gallery with block geobag reinforced fillers, comprises:

laying the block geobag reinforced fillers in the lateral peripheral regions as well as the top peripheral regions of the underground pipe gallery respectively; and filling the cement solidified slurry among the block geobag reinforced fillers, and making the cement solidified slurry be higher than a top of the block geobag reinforced fillers and fill up the gaps;

wherein grouting holes into the subgrade structure on the supporting cast-in-place piles, reinforcing the subgrade structure by split grouting, installing the anchor rods in the holes and grouting the holes for sealing;

wherein the placing geogrids on a top of the underground pipe gallery, then backfilling, compacting and reinforcing the top of the underground pipe gallery, and fixedly assembling anchor rods on the geogrids comprises:

backfilling a middle location on the top of the underground pipe gallery with coarse aggregate cement mixed backfilled soil, making the geogrids wrap the coarse aggregate cement mixed backfilled soil and form a loop with the block geobag reinforced fillers, fixing the anchor rods and the geogrids by strip gaskets and bolts, and connecting soil of the subgrade structure with an overall structure of the block geobag reinforced fillers under an action of mechanical compaction; and securing the anchor rods and the geogrids onto the supporting cast-in-place piles through the bolts and the strip gaskets, drilling the grouting holes in the soil of the subgrade structure, inserting and fixing the anchor rods in the grouting holes, and then grouting the grouting holes.

5. The subgrade with local deep excavation and backfilling structure according to claim 4, wherein geotechnical mold bags are laid between the top of the underground pipe gallery and the coarse aggregate cement mixed backfilled soil.

6. The subgrade with local deep excavation and backfilling structure according to claim 4, wherein the anchor rods are fixedly assembled with the geogrids by bolts and strip gaskets.

7. The subgrade with local deep excavation and backfilling structure according to claim 4, wherein a geotextile is installed between the block geobag reinforced fillers on the top of the underground pipe gallery and the geogrids.

* * * * *